US011722818B2

(12) United States Patent
Wang et al.

(10) Patent No.: US 11,722,818 B2
(45) Date of Patent: Aug. 8, 2023

(54) METHOD AND APPARATUS FOR RECOGNIZING WIND NOISE OF EARPHONE, AND EARPHONE

(71) Applicant: Beijing Xiaoniao Tingting Technology Co., LTD., Beijing (CN)

(72) Inventors: Jiudong Wang, Beijing (CN); Song Liu, Beijing (CN)

(73) Assignee: LITTLE BIRD CO., LTD, Beijing (CN)

( * ) Notice: Subject to any disclaimer, the term of this patent is extended or adjusted under 35 U.S.C. 154(b) by 0 days.

(21) Appl. No.: 17/645,971

(22) Filed: Dec. 24, 2021

(65) Prior Publication Data

US 2022/0210552 A1 Jun. 30, 2022

(30) Foreign Application Priority Data

Dec. 25, 2020 (CN) ..... 202011559834.8

(51) Int. Cl.
*H04R 1/10* (2006.01)
*H04R 3/00* (2006.01)

(52) U.S. Cl.
CPC ..... *H04R 3/005* (2013.01); *H04R 1/1083* (2013.01); *H04R 2410/07* (2013.01)

(58) Field of Classification Search
CPC .. H04R 3/005; H04R 1/1083; H04R 2410/07; H04R 2460/01; H04R 3/00;
(Continued)

(56) References Cited

U.S. PATENT DOCUMENTS 10,714,073 B1 7/2020 Rui
2017/0133000 A1 5/2017 Hendrix et al.
(Continued)

FOREIGN PATENT DOCUMENTS

CN 111833896 A * 10/2020

OTHER PUBLICATIONS

European Search Report in European Application No. 21217680.4, dated May 10, 2022.

*Primary Examiner* — Vivian C Chin
*Assistant Examiner* — Friedrich Fahnert
(74) *Attorney, Agent, or Firm* — Syncoda LLC; Feng Ma

(57) ABSTRACT

An earphone includes a feedforward microphone located outside ear and a feedback microphone located inside ear. A method for recognizing wind noise of the earphone includes: feedforward microphone signal collected by feedforward microphone and feedback microphone signal collected by feedback microphone are acquired; Fourier transform is performed on feedforward and feedback microphone signals to obtain a feedforward microphone frequency domain signal and a feedback microphone frequency domain signal; inverse feedback filtering processing is performed on the feedback microphone frequency domain signal to obtain an inverse feedback filtering processing result; inverse feedforward filtering processing is performed on the feedforward microphone frequency domain signal and the inverse feedback filtering processing result to obtain an inverse hybrid filtering processing result; and a wind noise recognition result of the earphone is obtained based on an interrelationship between the inverse feedback filtering processing result and the inverse hybrid filtering processing result.

18 Claims, 5 Drawing Sheets

(58) Field of Classification Search
CPC ..... G10K 11/17821; G10K 2210/1081; G10K 2210/30232; G10K 2210/3025; G10K 11/17835; G10K 11/17881
USPC ..... 381/94.1
See application file for complete search history.

(56) References Cited

U.S. PATENT DOCUMENTS

2019/0214036 A1* 7/2019 Wurtz ..... G10L 21/0208
2020/0020313 A1* 1/2020 Hua ..... H04R 1/1016

* cited by examiner

METHOD AND APPARATUS FOR RECOGNIZING WIND NOISE OF EARPHONE, AND EARPHONE

CROSS-REFERENCE TO RELATED APPLICATION

The application claims priority to Chinese Patent Application No. 202011559834.8 filed on Dec. 25, 2020, the disclosure of which is hereby incorporated herein by reference in its entirety.

BACKGROUND

In a noisy scenario, people often wear active noise cancellation earphones to reduce the noise actually heard by human ears, so as to achieve a better hearing experience. A typical active noise cancellation earphone includes a feedforward microphone located outside an ear and a feedback microphone located inside the ear. The feedforward microphone outside the ear is configured to detect the noise outside the ear, generate an electrical signal through feedforward noise cancellation, and transmit the electric signal to a loudspeaker to generate an acoustic signal with the same amplitude and opposite direction as the noise inside the ear, so as to achieve a purpose of reducing the noise inside the ear. Since the feedforward noise cancellation has a limited effect, residual noise inside the ear can also be further reduced by the feedback microphone located inside the ear through feedback noise cancellation, so as to achieve a better noise cancellation experience. In addition, the existing feedforward microphone and the feedback microphone of the active noise cancellation earphone may also be configured to make a call, that is, in an occasion where a user performs a voice call, a noise influence in an uplink voice signal (that is, a voice signal sent to the calling party) is suppressed by a processing algorithm.

SUMMARY

The disclosure relates to the technical field of wind noise recognition of an earphone, and in particular, to a method and apparatus for recognizing wind noise of an earphone, and an earphone.

An objective of the disclosure is to provide a method and apparatus for recognizing wind noise of an earphone, and an earphone, which are used for solving the technical problem of poor recognition accuracy or high recognition cost of the wind noise recognition method in some implementations.

According to a first aspect of the disclosure, a method for recognizing wind noise of an earphone is provided. The earphone includes a feedforward microphone located outside an ear and a feedback microphone located inside the ear. The method includes the following operations.

A feedforward microphone signal collected by the feedforward microphone and a feedback microphone signal collected by the feedback microphone are acquired.

Fourier transform is performed on the feedforward microphone signal and the feedback microphone signal to obtain a feedforward microphone frequency domain signal and a feedback microphone frequency domain signal.

Inverse feedback filtering processing is performed on the feedback microphone frequency domain signal to obtain an inverse feedback filtering processing result.

Inverse feedforward filtering processing is performed on the feedforward microphone frequency domain signal and the inverse feedback filtering processing result to obtain an inverse hybrid filtering processing result.

A wind noise recognition result of the earphone is obtained based on an interrelationship between the inverse feedback filtering processing result and the inverse hybrid filtering processing result.

According to a second aspect of the disclosure, an apparatus for recognizing wind noise of an earphone is provided. The earphone includes a feedforward microphone located outside an ear and a feedback microphone located inside the ear. The apparatus includes a processor and a memory configured to store instructions executable by the processor, where the processor is configured to:

acquire a feedforward microphone signal collected by the feedforward microphone and a feedback microphone signal collected by the feedback microphone;

perform Fourier transform on the feedforward microphone signal and the feedback microphone signal to obtain a feedforward microphone frequency domain signal and a feedback microphone frequency domain signal;

perform inverse feedback filtering processing on the feedback microphone frequency domain signal to obtain an inverse feedback filtering processing result;

perform inverse feedforward filtering processing on the feedforward microphone frequency domain signal and the inverse feedback filtering processing result to obtain an inverse hybrid filtering processing result; and obtain a wind noise recognition result of the earphone based on an interrelationship between the inverse feedback filtering processing result and the inverse hybrid filtering processing result.

According to a third aspect of the disclosure, an earphone is provided. The earphone includes a feedforward microphone located outside an ear, a feedback microphone located inside the ear, a loudspeaker, a processor, and a memory that stores computer executable instructions.

The executable instructions, when executed by the processor, cause the processor to implement following steps of: acquiring a feedforward microphone signal collected by the feedforward microphone and a feedback microphone signal collected by the feedback microphone; performing Fourier transform on the feedforward microphone signal and the feedback microphone signal to obtain a feedforward microphone frequency domain signal and a feedback microphone frequency domain signal; performing inverse feedback filtering processing on the feedback microphone frequency domain signal to obtain an inverse feedback filtering processing result; performing inverse feedforward filtering processing on the feedforward microphone frequency domain signal and the inverse feedback filtering processing result to obtain an inverse hybrid filtering processing result; and obtaining a wind noise recognition result of the earphone based on an interrelationship between the inverse feedback filtering processing result and the inverse hybrid filtering processing result.

According to a fourth aspect of the disclosure, a non-transitory computer-readable storage medium is provided. The computer-readable storage medium stores one or more computer programs. The one or more programs, when executed by a processor, implement the abovementioned method for recognizing wind noise of an earphone.

The disclosure has the beneficial effects that: the earphone applied to the method for recognizing wind noise of an earphone of the embodiments of the disclosure includes the structures, such as the feedforward microphone located outside the ear and the feedback microphone located inside the ear. When wind noise recognition is performed, first, the feedforward microphone signal collected by the feedforward microphone and the feedback microphone signal collected by the feedback microphone are acquired. In order to facilitate subsequent signal processing and calculation, the feedforward microphone signal and the feedback microphone signal can be converted into a frequency domain through Fourier transform here, and then the feedforward microphone frequency domain signal and the feedback microphone frequency domain signal are obtained respectively. Next, the inverse feedback filtering processing is performed on the feedback microphone frequency domain signal to obtain a frequency domain signal picked up when feedback noise cancellation of the feedback microphone is not enabled as an inverse feedback filtering processing result. The inverse feedforward filtering processing is performed on the obtained inverse feedback filtering processing result mentioned above in combination with the feedforward microphone frequency domain signal to obtain a frequency domain signal picked up when hybrid noise cancellation of the feedback microphone is enabled as an inverse hybrid filtering processing result. Finally, a wind noise recognition result of the earphone can be obtained based on an interrelationship between the inverse feedback filtering processing result and the inverse hybrid filtering processing result. According to the method for recognizing wind noise of an earphone of the embodiments of the disclosure, the wind noise recognition is performed by using the existing feedforward microphone and the feedback microphone, other microphones are not needed to be set additionally, the hardware cost is reduced, and the wind noise recognition effect is good.

BRIEF DESCRIPTION OF THE DRAWINGS

Other advantages and benefits will become clear to those of ordinary skill in the art by reading detailed description of the optional embodiments hereinbelow. The accompanying drawings are merely intended to illustrate the objectives of the optional embodiments and are not intended to limit the disclosure. Throughout the accompanying drawings, the same reference numerals represent the same components. In the drawings.

DETAILED DESCRIPTION

Figure 1:
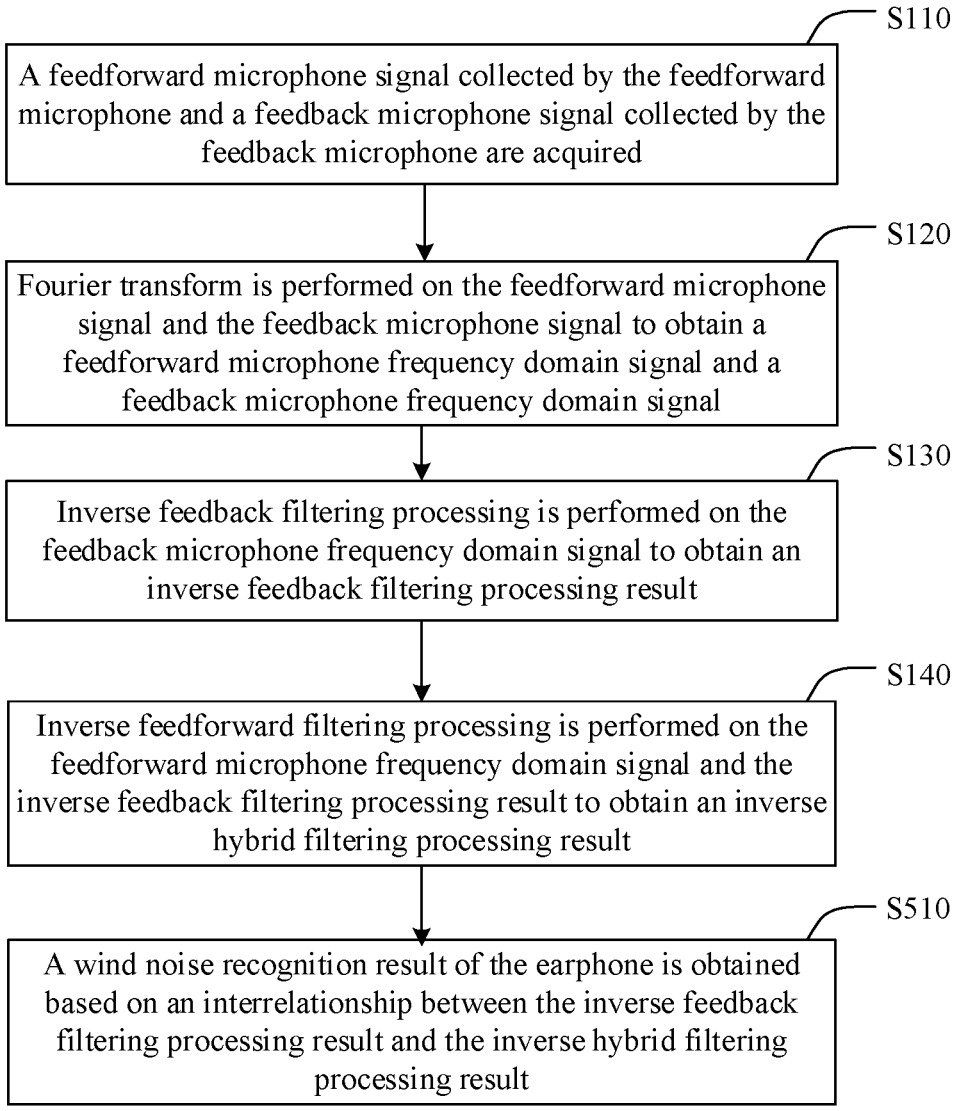
FIG. 1 illustrates a flowchart of a method for recognizing wind noise of an earphone according to an embodiment of the disclosure.

The following describes exemplary embodiments of the disclosure in more detail with reference to the accompanying drawings. These embodiments are provided to enable a more thorough understanding of the disclosure and completely convey the scope of the disclosure to a person skilled in the art. Although the exemplary embodiments of the disclosure are shown in the accompanying drawings, it is to be understood that the disclosure may be implemented in various forms and should not be limited by the embodiments set forth herein.

An earphone will inevitably encounter wind noise during use. A principle of wind noise generation is: when wind encounters an obstacle, a turbulent flow (also called a disturbed flow) is generated, and the turbulent flow causes a fluctuation in the air pressure near a cavity of the microphone. The noise generated by the turbulent flow is amplified by resonating with an air column in the cavity of the microphone, and the amplified noise is picked up by the microphone, so that wind noise is generated. The wind noise is not generated in a human ear, but only at a microphone end. Therefore, after the feedforward noise cancellation is enabled, the wind noise will cross into the human ear, resulting in a bad experience when a user listens to music. Furthermore, the wind noise will also have an influence on a call, resulting in the decline of call definition. In order to reduce the influence of the wind noise, first, the wind noise needs to be recognized, and then the influence of the wind noise is reduced through some measures.

However, the inventors of the present disclosure have recognized that the wind noise recognition method in some implementations may need to be further improved in terms of recognition accuracy or recognition cost.

In some implementations, there is a solution for performing wind noise recognition by using a microphone outside an ear (a feedforward microphone), which needs to establish a wind noise signal database with different wind power and different wind directions in an early stage, so as to extract wind noise features and perform comparison and recognition. The solution not only has high complexity, but also has a large amount of calculation workload. Once there is wind noise not existing in the database, the recognition accuracy will be greatly reduced.

There is also another solution where wind noise is recognized by using dual microphones outside the ear, which recognizes the wind noise by using the information, such as the correlation of the signals acquired by the dual microphones outside the ear (the correlation of the noise signals generated by the wind noise at the two microphones outside the ear is very low, while the correlation of other external sounds is high), although the accuracy is high, but it is necessary to add another microphone outside the ear in addition to an active noise cancellation earphone. Thus, both the hardware cost and processing overheads will increase.

In addition, in a case where feedforward noise cancellation is enabled or hybrid noise cancellation of the earphone is enabled (that is, the feedforward noise cancellation and the feedback noise cancellation are enabled at the same time), the wind noise outside the ear will cross into the ear after being subjected to feedforward noise cancellation, which results in high coherence of microphone signals inside and outside the ear. In this case, the existence of the wind noise cannot be recognized by using coherence information. Based on this, the embodiment of the disclosure provides a method which may perform wind noise in the case where the feedforward noise cancellation or the hybrid noise cancellation of the earphone is enabled.

Figure 2:
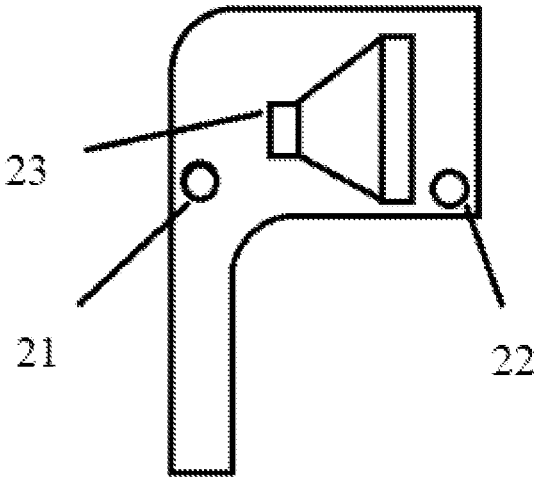
FIG. 2 illustrates a structural schematic diagram of an earphone according to an embodiment of the disclosure.

Specifically, FIG. 1 shows a flow chart of a method for recognizing wind noise of an earphone according to an embodiment of the disclosure. FIG. 2 shows a structural schematic diagram of an earphone provided according to an embodiment of the disclosure. The earphone includes a microphone outside an ear (a feedforward microphone) 21, arranged at the position, close to the outside of the ear, of an earphone housing, and configured to pick up an ambient noise signal outside the ear; a microphone inside the ear (a feedback microphone) 22, arranged at a front end of a loudspeaker, and configured to pick up a noise signal in the ear, and the loudspeaker 23, configured to play a sound source. The feedforward microphone 21 is configured to perform feedforward noise cancellation of the earphone, and the feedback microphone 22 is configured to perform feedback noise cancellation of the earphone. When the two types of noise cancellation are enabled at the same time, it is called hybrid noise cancellation. Feedforward noise cancellation, feedback noise cancellation, and hybrid noise cancellation may be regarded as one type of active noise cancellation.

As shown in FIG. 1, the method for recognizing wind noise of an earphone of the embodiments of the disclosure specifically includes S110 to S150 as follows.

At S110, a feedforward microphone signal collected by the feedforward microphone and a feedback microphone signal collected by the feedback microphone are acquired.

As previously mentioned, the feedforward microphone is arranged at the position, close to the outside of the ear, of the earphone housing, which may pick up an ambient noise signal outside the ear. The feedback microphone is arranged at the front end of the loudspeaker, which may pick up a noise signal inside the ear. Therefore, according to the embodiment of the disclosure, the feedforward microphone signal collected by the feedforward microphone and the feedback microphone signal collected by the feedback microphone may be acquired first as a basic signal of wind noise recognition.

At S120, Fourier transform is performed on the feedforward microphone signal and the feedback microphone signal to obtain a feedforward microphone frequency domain signal and a feedback microphone frequency domain signal.

After the feedforward microphone signal collected by the feedforward microphone and the feedback microphone signal collected by the feedback microphone are obtained, in order to facilitate subsequent signal processing and calculation, the feedforward microphone signal and the feedback microphone signal can be converted into a frequency domain through Fourier transform here, and then the feedforward microphone frequency domain signal (FFmic) and the feedback microphone frequency domain signal (FBmic) are obtained respectively.

At S130, inverse feedback filtering processing is performed on the feedback microphone frequency domain signal to obtain an inverse feedback filtering processing result.

Inverse feedback filtering processing is performed on the obtained feedback microphone frequency domain signal (FBmic) mentioned above, so as to obtain the inverse feedback filtering processing result ($FB_{invfb}$). The inverse feedback filtering processing here may be understood as restoring the frequency domain signal picked up by the feedback microphone to a state when the feedback noise cancellation of the earphone is not enabled.

At S140, inverse feedforward filtering processing is performed on the feedforward microphone frequency domain signal and the inverse feedback filtering processing result, so as to obtain an inverse hybrid filtering processing result.

When the abovementioned inverse feedback filtering processing result ($FB_{invfb}$) is obtained, the inverse feedback filtering processing needs to be performed on the inverse feedback filtering processing result in further combination with the feedforward microphone frequency domain signal, so as to obtain the inverse hybrid filtering processing result ($FB_{inv}$). Since the inverse feedforward filtering processing is further performed based on the inverse feedback processing, the inverse feedforward filtering processing here may be understood as restoring the frequency domain signal picked up by the feedback microphone to a state when the hybrid noise cancellation (including the feedforward noise cancellation and the feedback noise cancellation) of the earphone is not enabled. It is to be noted that the inverse feedforward filtering processing is not performed on the feedforward microphone frequency domain signal per se in the step. Since the feedforward microphone frequency domain signal is produced outside the ear and is not affected by active noise cancellation, it is only necessary to take into account the influence of the feedforward microphone frequency domain signal on the feedback microphone frequency domain signal inside the ear.

At S150, a wind noise recognition result of the earphone is obtained based on an interrelationship between the inverse feedback filtering processing result and the inverse hybrid filtering processing result.

After the inverse feedback filtering processing result ($FB_{invfb}$) and the inverse hybrid filtering processing result ($FB_{inv}$) are obtained, a recognition result of earphone wind noise, including the recognition result indicating presence of the wind noise or the recognition result indicating absence of the wind noise, may be determined based on an interrelationship therebetween, such as a proportional relationship.

According to the method for recognizing wind noise of an earphone of the embodiments of the disclosure, the wind noise recognition is performed by using the existing feedforward microphone and the feedback microphone, other microphones are not needed to be set additionally, the hardware cost is reduced, and the wind noise recognition effect is good.

In an embodiment of the disclosure, the inverse feedback filtering processing is implemented by the following formula:

$$FB_{invfb} = FBmic \times (1 - H_{fb} \times G). \tag{1}$$

Herein, $FB_{invfb}$ is the inverse feedback filtering processing result, FBmic is the feedback microphone frequency domain signal, $H_{fb}$ is a frequency response of a feedback filter used when feedback noise cancellation of the earphone is enabled at a current time, and G is a transfer function from a loudspeaker inside the earphone to the feedback microphone.

The inverse feedback filtering processing is implemented by the following formula:

$$FB_{inv} = FB_{invfb} - FFmic \times H_{ff} \times G. \tag{2}$$

Herein, $FB_{inv}$ is the inverse hybrid filtering result, FFmic is the feedforward microphone frequency domain signal, $H_{ff}$ is a frequency response of a feedback filter used when the feedforward noise cancellation of the earphone is enabled at the current time, and G is a transfer function from the loudspeaker inside the earphone to the feedback microphone.

As previously mentioned, an objective of the inverse feedback filtering processing is to restore the frequency domain signal picked up by the feedback microphone to the state when the feedback noise cancellation of the earphone is not enabled. An objective of the inverse feedforward filtering processing is to restore the frequency domain signal picked up by the feedback microphone to the state when the hybrid noise cancellation of the earphone is not enabled. Therefore, according to the embodiment of the disclosure, the inverse feedback filtering processing result before the feedback noise cancellation is enabled may be obtained through the above formula (1), and the inverse hybrid filtering processing result before the hybrid noise cancellation is enabled may be obtained through the above formula (2), so as to provide an accurate frequency domain signal as a basis for subsequent wind noise recognition.

The transfer function G from the loudspeaker inside the earphone to the feedback microphone in the above formulas (1) and (2) may be determined by collecting a sound source signal of the loudspeaker and the feedback microphone signal picked by the feedback microphone, and calculating a corresponding relationship therebetween. Here, there may be two calculation methods: one is to obtain the transfer function G by off-line calculation in advance (that is, determine through measurement in a laboratory), and the transfer function G obtained by the off-line calculation in advance may be called directly during use, which consumes shorter time. Considering that different people have different earphone wearing situations, there are also some differences in the structures inside ears, and the coupling degrees between an earphone and the ears of different people are different, the collected signals are also different. Therefore, the transfer function G may be determined by a statistical method after signal data of a plurality of people are collected in advance, so as to improve the calculation accuracy. The other calculation method is to obtain the transfer function G by real-time calculation. The transfer function G may be calculated more accurately according to the coupling degrees between the ears of different people and the earphone, so that the accuracy is relatively higher. Which method is used to calculate the transfer function G specifically may be flexibly selected by those skilled in the art according to actual situations, which is not specifically limited herein.

Specifically, the transfer function obtained by real-time measurement may be calculated based on the following formula (3):

$$G = \frac{E[FBmic(f, t) \times \mathrm{Re}\ f^*(f, t)]}{E\left[|\mathrm{Re}\ f(f, t)|^2\right]}. \tag{3}$$

Herein, E[ ] is an operation for calculating expectation, a Ref (f,t) signal is a sound source frequency domain signal played by the loudspeaker at time t, FBmic (f, t) is a microphone frequency domain signal inside the ear at time t, and Re f* is a conjugate signal of the Ref signal.

In an embodiment of the disclosure, after the inverse feedback filtering processing result and the inverse hybrid filtering processing result are obtained, the method further includes: a loudspeaker sound source frequency domain signal played by a loudspeaker inside the earphone is acquired; acoustic echo cancellation processing is performed on the inverse feedback filtering processing result and the inverse hybrid filtering processing result according to the loudspeaker sound source frequency domain signal, so as to obtain a more ideal processing result.

When the earphone of the embodiments of the disclosure is in use, the loudspeaker can play a sound source to produce a loudspeaker sound source signal (Ref), for example, a music signal and a downlink signal during calling. The loudspeaker sound source signal crosses into the microphone to cause an acoustic echo after being sent by the loudspeaker, which results in a poor audio effect heard by an opposite user of the call, and meanwhile, will affect the accuracy of subsequent wind noise recognition. Therefore, the acoustic echo cancellation processing may be performed herein. According to the embodiment of the disclosure, when the acoustic echo cancellation processing is performed, first the sound source signal played by the loudspeaker is obtained, and then the loudspeaker sound source signal is also converted to the frequency domain through Fourier transform, so as to facilitate subsequent calculation.

Since an acoustic echo signal and the loudspeaker sound source signal (Ref) in the signals received by the microphone are related, that is, there is a transfer function (H) from the loudspeaker sound source signal to the acoustic echo signal of the microphone, acoustic echo information of the signal received by the microphone may be estimated through the loudspeaker sound source signal by using relevant information, so as to remove an acoustic echo signal part in the microphone signal.

Specifically, the obtained inverse feedback filtering processing result and the inverse hybrid filtering processing result mentioned above serve as target signals (des), the loudspeaker sound source signal serves as a reference signal (Ref), and an optimal filter weight may be obtained by using a Normalized Least Mean Square (NLMS) adaptive algorithm. The filter is an impulse response of the abovementioned transfer function (H). The acoustic echo signal part in a target signal is estimated according to a convolution result of the filter weight and the reference signal, and the target signal after acoustic echo cancellation may be obtained by subtracting the acoustic echo signal part from the target signal. It is to be noted that the abovementioned acoustic echo cancellation processing step is only an optional step. If the loudspeaker of the earphone does not play a sound source, that is, the loudspeaker sound source signal is not produced, at this time, there is no problem about acoustic echo, so an acoustic echo cancellation step may be omitted.

In an embodiment of the disclosure, the step that a wind noise recognition result of the earphone is obtained based on an interrelationship between the inverse feedback filtering processing result and the inverse hybrid filtering processing result includes: a ratio of the energy of inverse hybrid filtering processing result to energy of the inverse feedback filtering processing result is calculated; if the ratio is greater than a first preset threshold value, the wind noise recognition result of the earphone is determined as absence of the wind noise; if the ratio is less than a second preset threshold value, the wind noise recognition result of the earphone is determined as presence of the wind noise, where the first preset threshold value is greater than the second threshold value; and if the ratio is between the second threshold value and the first threshold value, a last wind noise recognition result of the earphone is determined as a current wind noise recognition result of the earphone.

When the hybrid noise cancellation of the earphone is enabled, the inventor found that when a scenario outside the ear is a common noisy scenario (a scenario without wind noise), the noise inside the ear will be reduced after the hybrid noise cancellation is enabled compared with that before the hybrid noise cancellation is enabled. When the scenario outside the ear is a scenario with wind noise, the wind noise crosses into the ear through the feedforward microphone, so that the noise inside the ear will become higher after the hybrid noise cancellation is enabled compared with that before the hybrid noise cancellation is enabled. As previously mentioned, an objective of the inverse feedback filtering processing is to restore the frequency domain signal picked up by the feedback microphone to the state when the feedback noise cancellation of the earphone is not enabled. An objective of the inverse feedforward filtering processing is to restore the frequency domain signal picked up by the feedback microphone to the state when the hybrid noise cancellation of the earphone is not enabled. Therefore, according to the embodiment of the disclosure, the inverse feedback filtering processing result before the feedback noise cancellation is enabled may be obtained through the above formula (1), and the inverse hybrid filtering processing result before the hybrid noise cancellation is enabled may be obtained through the above formula (2), so as to provide an accurate frequency domain signal as a basis for subsequent wind noise recognition.

Therefore, whether the scenario is a scenario with wind noise may be determined by selecting and comparing the signal energy before the hybrid noise cancellation is enabled and the signal energy after the hybrid noise cancellation is enabled. Preferably, a frequency band with an apparent effect of feedforward noise cancellation may be selected for energy calculation and comparison. That is, the frequency band with the apparent effect of feedforward noise cancellation may be determined first, and then the determined frequency band with the apparent effect of feedforward noise cancellation may be selected for calculating the ratio of the energy of the inverse hybrid filtering processing result to the inverse feedback filtering processing result, and then the ratio of the energies is compared.

Based on this, according to the embodiment of the disclosure, a first preset threshold value T1 and a second preset threshold value T2 may be set in advance for performing wind noise recognition, herein, T1>T2. It is assumed that $$FB_{inv_A} = \sum_{f=freq1}^{freq2} |FB_{inv}(f)|^2 \text{ and } FB_{invfb_A} = \sum_{f=freq1}^{freq2} |FB_{invfb}(f)|^2,$$

where $FB_{inv}$_A represents an energy value of the inverse hybrid filtering processing result in the frequency band {freq1, freq2}, and $FB_{invfb}$_A represents an energy value of the inverse feedback filtering processing result in the frequency band {freq1, freq2}. The ratio is assumed to be $$R = \frac{FB_{inv_A}}{FB_{invfb_A}},$$

when R is greater than the threshold value T1, it indicates that the energy before the hybrid noise cancellation is enabled is large, and it is considered that the scenario outside the ear is a scenario without wind noise at this time. When R is less than the threshold value T2, it indicates that the energy before the hybrid noise cancellation is enabled is small and the energy after the hybrid noise cancellation is enabled is large, and it is considered that there is wind crossing into the ear through the microphone at this time, which results in that the noise in the ear becomes higher, and then it is determined that the scenario outside the ear is a scenario with wind noise.

In another embodiment, if the value of R is between the threshold value T1 and the threshold value T2, then the last wind noise determination result is determined as a determination result of this time.

In an embodiment of the disclosure, the feedback microphone frequency domain signal is directly determined as the inverse feedback filtering processing result when only the feedforward noise cancellation is enabled.

When only the feedforward noise cancellation of the earphone is enabled, it may be considered that the frequency response $H_{fb}$ of the feedback filter used when feedback noise cancellation of the earphone is enabled at the current time is equal to 0. It can be seen from the formula (1) in the above embodiments that the inverse feedback filtering processing result is the feedback microphone frequency domain signal FBmic. Therefore, in a case where only the feedforward noise cancellation of the earphone is enabled, the wind noise recognition may still be performed through the abovementioned embodiments.

In an embodiment of the disclosure, the method further includes: after the wind noise recognition result of the earphone is obtained, the wind noise is suppressed in one or more manners as follows: the gain of the feedforward microphone is reduced, the feedforward microphone is turned off, or attenuation is performed on a low-frequency signal of the feedforward microphone signal collected by the feedforward microphone.

After it is recognized that the current scenario is the scenario with the wind noise, a corresponding subsequent processing measure may be taken to reduce adverse effects of the wind noise. For example, the gain of the feedforward microphone is reduced to reduce a situation that the wind noise crosses into the ear due to enabling of the feedforward noise cancellation; or the feedforward microphone is turned off to avoid the situation that the wind noise crosses into the ear due to enabling of the feedforward noise cancellation when there is wind noise; or attenuation is only performed on a low-frequency signal of the feedforward microphone signal of the feedforward microphone, since the wind noise is mainly concentrated at a low frequency, on one hand, the situation that the wind noise crosses in a low-frequency band inside the ear due to enabling of the feedforward noise cancellation may be reduced, and on the other hand, other frequency bands may also retain a certain noise cancellation effect.

Figure 3:
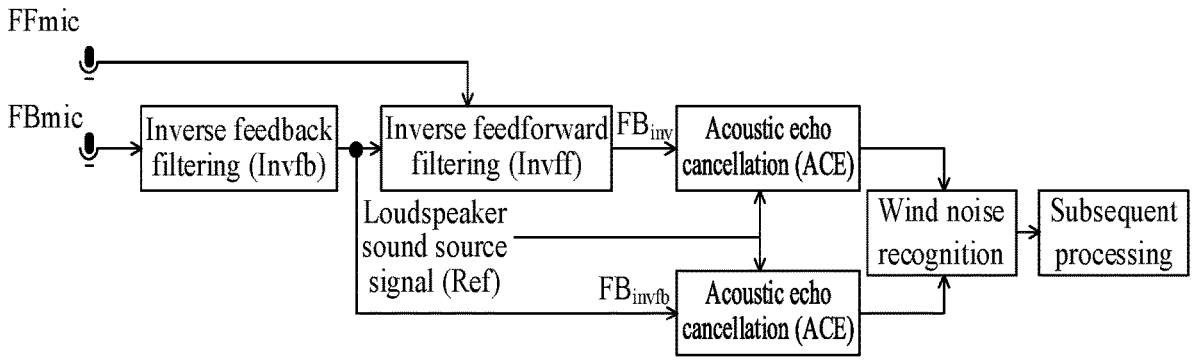
FIG. 3 illustrates a flow chart of the method for recognizing wind noise of an earphone according to an embodiment of the disclosure.

As shown in FIG. 3, a flow chart of wind noise recognition of an earphone is provided. First, a feedforward microphone signal collected by a feedforward microphone and a feedback microphone signal collected by a feedback microphone are acquired, and Fourier transform processing is performed to obtain a feedforward microphone frequency domain signal FFmic and a feedback microphone frequency domain signal FBmic. Then, inverse feedback filtering processing is performed on the FBmic to obtain an inverse feedback filtering processing result $FB_{invfb}$. Inverse feedforward filtering processing is performed on the inverse feedback filtering processing result $FB_{invfb}$ in combination with the feedforward microphone frequency domain signal FFmic, so as to obtain an inverse hybrid filtering processing result $FB_{inv}$. Next, acoustic echo cancellation processing is performed on the inverse feedback filtering processing result $FB_{invfb}$ and the inverse hybrid filtering processing result $FB_{inv}$ according to the loudspeaker sound source signal Ref played by the loudspeaker. Finally, wind noise recognition is performed according to the inverse feedback filtering processing result $FB_{invfb}$ and the inverse hybrid filtering processing result $FB_{inv}$ after the acoustic echo cancellation processing, so as to perform subsequent processing, such as wind noise suppression, according to a wind noise recognition result.

Figure 4:
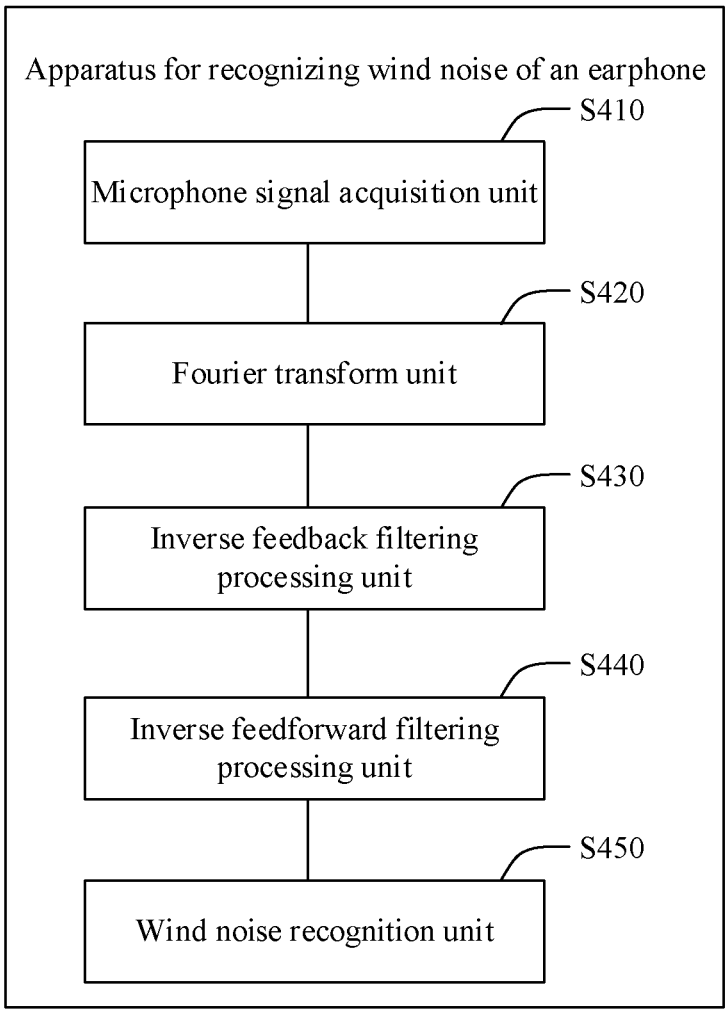
FIG. 4 illustrates a block diagram of an apparatus for recognizing wind noise of an earphone according to an embodiment of the disclosure.

Belonging to the same technical concept as the abovementioned method for recognizing wind noise of an earphone, the embodiments of the disclosure also provide an apparatus for recognizing wind noise of an earphone. An earphone includes a feedforward microphone located outside an ear and a feedback microphone located inside the ear. FIG. 4 shows a block diagram of an apparatus for recognizing wind noise of an earphone according to an embodiment of the disclosure. Referring to FIG. 4, the apparatus for recognizing wind noise of an earphone 400 includes: a microphone signal acquisition unit 410, a Fourier transform unit 420, an inverse feedback filtering processing unit 430, an inverse feedforward filtering processing unit 440, and a wind noise recognition unit 450.

The microphone signal acquisition unit 410 is configured to acquire a feedforward microphone signal collected by the feedforward microphone and a feedback microphone signal collected by the feedback microphone.

The Fourier transform unit 420 is configured to perform Fourier transform on the feedforward microphone signal and the feedback microphone signal to obtain a feedforward microphone frequency domain signal and a feedback microphone frequency domain signal.

The inverse feedback filtering processing unit 430 is configured to perform inverse feedback filtering processing on the feedback microphone frequency domain signal to obtain an inverse feedback filtering processing result.

The inverse feedforward filtering processing unit 440 is configured to perform inverse feedforward filtering processing on the feedforward microphone frequency domain signal and the inverse feedback filtering processing result to obtain an inverse hybrid filtering processing result.

The wind noise recognition unit 450 is configured to obtain a wind noise recognition result of the earphone based on an interrelationship between the inverse feedback filtering processing result and the inverse hybrid filtering processing result.

In an embodiment of the disclosure, the inverse feedback filtering processing is implemented by the following formula:

$$FB_{invfb} = FBmic \times (1 - H_{fb} \times G). \quad (1)$$

Herein, $FB_{invfb}$ is the inverse feedback filtering processing result, FBmic is the feedback microphone frequency domain signal, $H_{fb}$ is a frequency response of a feedback filter used when feedback noise cancellation of the earphone is enabled at a current time, and G is a transfer function from a loudspeaker inside the earphone to the feedback microphone.

The inverse feedback filtering processing is implemented by the following formula:

$$FB_{inv} = FB_{invfb} - FFmic \times H_{ff} \times G. \quad (2)$$

Herein, $FB_{inv}$ is the inverse hybrid filtering result, FFmic is the feedforward microphone frequency domain signal, $H_{ff}$ is a frequency response of a feedback filter used when the feedforward noise cancellation of the earphone is enabled at the current time, and G is a transfer function from the loudspeaker inside the earphone to the feedback microphone.

In an embodiment of the disclosure, the apparatus further includes: a loudspeaker sound source signal acquisition unit, configured to acquire a loudspeaker sound source frequency domain signal played by a loudspeaker inside the earphone after the inverse feedback filtering processing result and the inverse hybrid filtering processing result are obtained; and an acoustic echo cancellation processing unit, configured to perform acoustic echo cancellation processing on the inverse feedback filtering processing result and the inverse hybrid filtering processing result according to the loudspeaker sound source frequency domain signal.

In an embodiment of the disclosure, the wind noise recognition unit 450 is specifically configured to: calculate a ratio of energy of the inverse hybrid filtering processing result to energy of the inverse feedback filtering processing result; if the ratio is greater than a first preset threshold value, determine the wind noise recognition result of the earphone as absence of the wind noise; if the ratio is less than a second preset threshold value, determine the wind noise recognition result of the earphone as presence of the wind noise, where the first preset threshold value is greater than the second preset threshold value; and if the ratio is between the second preset threshold value and the first preset threshold value, determine a last wind noise recognition result of the earphone as the current wind noise recognition result of the earphone.

In an embodiment of the disclosure, the wind noise recognition unit 450 is configured to select a frequency band with an apparent effect of feedforward noise cancellation to perform energy calculation and comparison, when the ratio of the energy of the inverse hybrid filtering processing result to the energy of the inverse feedback filtering processing result is calculated.

In an embodiment of the disclosure, the inverse feedback filtering processing unit 430 is configured to: directly determine the feedback microphone frequency domain signal as the inverse feedback filtering processing result when only the feedforward noise cancellation is enabled.

In an embodiment of the disclosure, the apparatus further includes: a wind noise suppression unit, configured to suppress, after the wind noise recognition result of the earphone is obtained, the wind noise in one or more manners as follows: the gain of the feedforward microphone is reduced, the feedforward microphone is turned off, or attenuation is performed on a low-frequency signal of the feedforward microphone signal collected by the feedforward microphone.

Figure 5:
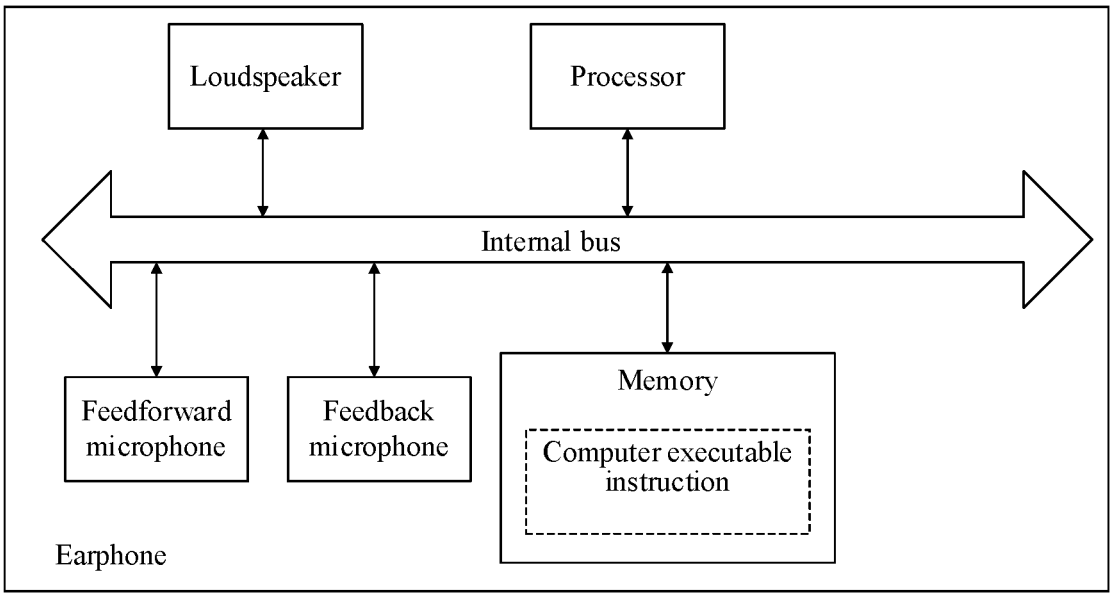
FIG. 5 illustrates a structural schematic diagram of the earphone in another embodiment of the disclosure.

It is to be noted that FIG. 5 shows a structural schematic diagram of an earphone. Referring to FIG. 5, at a hardware level, the earphone includes a feedforward microphone located outside an ear, a feedback microphone located inside the ear, a loudspeaker, a memory, and a processor. Optionally, the earphone further includes an interface module, a communication module, etc. The memory may include internal memory, such as a Random-Access Memory (RAM), and may also include a non-volatile memory, such as at least magnetic disk memory. Of course, the earphone may also include hardware required by other services.

The processor, the interface module, the communication module, and the memory may be interconnected through an internal bus. The internal bus may be an Industry Standard Architecture (ISA) bus, a Peripheral Component Interconnect (PCI) bus, an Extended Industry Standard Architecture (EISA), or the like. The bus may be classified into an address bus, a data bus, a control bus, or the like. For ease of representation, FIG. 5 is only represented by using a bidirectional arrow, but this does not mean that there is only one bus or only one type of bus.

The memory is configured to store computer executable instructions. The memory provides the computer executable instructions to the processor through an internal bus.

The processor executes the computer executable instruction stored in the memory, and is specifically configured to implement the following operations.

A feedforward microphone signal collected by a feedforward microphone and a feedback microphone signal collected by a feedback microphone are acquired.

Fourier transform is performed on the feedforward microphone signal and the feedback microphone signal to obtain a feedforward microphone frequency domain signal and a feedback microphone frequency domain signal.

Inverse feedback filtering processing is performed on the feedback microphone frequency domain signal to obtain an inverse feedback filtering processing result.

Inverse feedforward filtering processing is performed on the feedforward microphone frequency domain signal and the inverse feedback filtering processing result to obtain an inverse hybrid filtering processing result.

A wind noise recognition result of the earphone is obtained based on an interrelationship between the inverse feedback filtering processing result and the inverse hybrid filtering processing result.

The functions that are disclosed in the embodiment shown in FIG. 4 of the application and executed by the apparatus for recognizing wind noise of an earphone may be applied to the processor or implemented by the processor. The processor may be an integrated circuit chip with signal processing capability. In the implementation process, each step of the above method may be completed by an integrated logic circuit of hardware in the processor or an instruction in the form of software. The processor may be a general-purpose processor, including a Central Processing Unit (CPU), a Network Processor (NP), etc., or may be a Digital Signal Processor (DSP), an Application Specific Integrated Circuit (ASIC), a Field Programmable Gate Display (FPGA), or other programmable logic devices, discrete gates or transistor logic devices, and discrete hardware components. The methods, steps, and logical block diagrams that are disclosed in the embodiments of this application may be implemented or performed. The general-purpose processor may be a microprocessor, any conventional processor, or the like. Steps of the methods disclosed with reference to the embodiments of this application may be directly performed and accomplished by a hardware decoding processor, or may be performed and accomplished by a combination of hardware and software modules in the decoding processor. The software module may be located in a storage medium mature in the art, such as a random-access memory, a flash memory, a read-only memory, a programmable read-only memory or electrically erasable programmable memory, or a register. The storage medium is located in the memory, and the processor reads information in the memory and completes the steps in the foregoing methods in combination with hardware of the processor.

The earphone may further execute the steps of the method for recognizing wind noise of an earphone shown in FIG. 1 and implement the functions of the method for recognizing wind noise of an earphone in the embodiment shown in FIG. 1, which will not be elaborated in the embodiments of the disclosure.

The embodiments of the disclosure further provide a computer-readable storage medium. The computer-readable storage medium stores one or more programs. The one or more programs, when being executed by a processor, implement the foregoing method for recognizing wind noise of an earphone, and are specifically used to execute the following operations.

A feedforward microphone signal collected by a feedforward microphone and a feedback microphone signal collected by a feedback microphone are acquired.

Fourier transform is performed on the feedforward microphone signal and the feedback microphone signal to obtain a feedforward microphone frequency domain signal and a feedback microphone frequency domain signal.

Inverse feedback filtering processing is performed on the feedback microphone frequency domain signal to obtain an inverse feedback filtering processing result.

Inverse feedforward filtering processing is performed on the feedforward microphone frequency domain signal and the inverse feedback filtering processing result to obtain an inverse hybrid filtering processing result.

A wind noise recognition result of the earphone is obtained based on an interrelationship between the inverse feedback filtering processing result and the inverse hybrid filtering processing result.

Those skilled in the art should understand that the embodiments of the disclosure may be provided as a method, a system, or a computer program product. Thus, the disclosure may adopt forms of complete hardware embodiments, complete software embodiments or embodiments integrating software and hardware. Moreover, the disclosure may adopt the form of a computer program product implemented on one or more computer available storage media (including, but not limited to, a disk memory, a CD-ROM, an optical memory, etc.) containing computer available program code.

The disclosure is described according to flowcharts and/or block diagrams of the method, the device (system), and the computer program product according to the embodiments of the disclosure. It is be understood that each flow and/or block in the flowcharts and/or block diagrams and combinations of flows and/or blocks in the flowcharts and/or block diagrams may be implemented by computer program instructions. These computer program instructions may be provided to a general-purpose computer, a special-purpose computer, an embedded processor, or a processor of another programmable data processing device to generate a machine, so that instructions executed by the computer or the processor of the another programmable data processing device produce an apparatus for implementing functions specified in one or more flows in the flowcharts and/or one or more blocks in the block diagrams.

These computer program instructions may also be stored in a computer readable memory capable of guiding a computer or another programmable data processing device to work in a specific way, so that instructions stored in the computer readable memory produce a product including an instruction apparatus. The instruction apparatus implements functions specified in one or more flows in the flowcharts and/or one or more blocks in the block diagrams.

These computer program instructions may also be loaded onto a computer or another programmable data processing device, so that a series of operating steps are performed on the computer or the another programmable data processing device to produce a computer-implemented process. Therefore, instructions executed on the computer or the another programmable data processing device provide steps for implementing functions specified in one or more flows in the flowcharts and/or one or more blocks in the block diagrams.

In a typical configuration, the computer includes one or more central processing units (CPUs), an input/output interface, a network interface, and a memory.

The memory may include a non-persistent memory, a Random-Access Memory (RAM), and/or a non-volatile memory in a computer readable medium, such as a Read-Only Memory (ROM) or a flash RAM. The memory is an example of the computer-readable medium.

The computer-readable medium includes persistent, non-persistent, movable, and unmovable media that may store information by using any method or technology. The information may be a computer-readable instruction, a data structure, a program module, or other data. Examples of computer storage media include, but are not limited to, a phase-change memory (PRAM), a static random access memory (SRAM), a dynamic random access memory (DRAM), other types of random access memories (RAM), a read-only memory (ROM), an electrically erasable programmable read-only memory (EEPROM), a flash memory or other memory technologies, a compact disc read-only memory (CD-ROM), a digital versatile disc (DVD) or other optical storage, a magnetic cassette, a magnetic tape, a magnetic disk storage or other magnetic storage devices, or any other non-transmission media, which can be used to store information that can be accessed by a computing device. As definition in the specification, the computer-readable medium does not include computer-readable transitory media such as a modulated data signal and a carrier.

It is also to be noted that the terms "include", "contain" or any other variation thereof are intended to cover nonexclusive inclusion, so that a process, method, commodity or device including a series of elements includes not only those elements, but also other elements not explicitly listed, or inherent elements in such process, method, commodity, or device. In the absence of more restrictions, elements described by the phrase "include a/an . . . " do not exclude the existence of additional identical elements in the process, method, article, or device that includes the elements.

Those skilled in the art should understand that the embodiments of the disclosure can be provided as methods systems or computer program products. Therefore, the embodiments of the disclosure can adopt forms of complete hardware embodiments, complete software embodiments or embodiments integrating software and hardware. Moreover, the disclosure can adopt the form of a computer program product implemented on one or more computer available storage media (including, but not limited to, a disk memory, a CD-ROM, an optical memory, etc.) containing computer available program code.

The above is only the embodiments of the disclosure, not intended to limit the disclosure. Various changes and variations of the disclosure will occur to those skilled in the art. Any modifications, equivalent substitutions, improvements, etc. that come within the spirit and principles of the disclosure are intended to be included within the scope of the claims of the disclosure.

What is claimed is:

1. A method for recognizing wind noise of an earphone, the earphone comprising a feedforward microphone located outside an ear and a feedback microphone located inside the ear, wherein the method comprises:

acquiring a feedforward microphone signal collected by the feedforward microphone and a feedback microphone signal collected by the feedback microphone;

performing Fourier transform on the feedforward microphone signal and the feedback microphone signal to obtain a feedforward microphone frequency domain signal and a feedback microphone frequency domain signal;

performing inverse feedback filtering processing on the feedback microphone frequency domain signal to obtain an inverse feedback filtering processing result;

performing inverse feedforward filtering processing on the feedforward microphone frequency domain signal and the inverse feedback filtering processing result to obtain an inverse hybrid filtering processing result; and obtaining a wind noise recognition result of the earphone based on an interrelationship between the inverse feedback filtering processing result and the inverse hybrid filtering processing result, wherein the inverse feedback filtering processing is implemented through the following formula:

$$FB_{invfb} = FBmic \times (1 - H_{fb} \times G),$$

wherein $FB_{invfb}$ is the inverse feedback filtering processing result, FBmic is the feedback microphone frequency domain signal, $H_{fb}$ is a frequency response of a feedback filter used when feedback noise cancellation of the earphone is enabled at a current time, and G is a transfer function from a loudspeaker inside the earphone to the feedback microphone; and the inverse feedback filtering processing is implemented by the following formula:

$$FB_{inv} = FB_{invfb} - FFmic \times H_{ff} \times G,$$

wherein $FB_{inv}$ is the inverse hybrid filtering processing result, FFmic is the feedforward microphone frequency domain signal, $H_{ff}$ is a frequency response of a feedback filter used when feedforward noise cancellation of the earphone is enabled at the current time, and G is the transfer function from the loudspeaker inside the earphone to the feedback microphone.

2. The method of claim 1, further comprising: after the inverse feedback filtering processing result and the inverse hybrid filtering processing result are obtained, acquiring a loudspeaker sound source frequency domain signal played by a loudspeaker inside the earphone; and performing acoustic echo cancellation processing on the inverse feedback filtering processing result and the inverse hybrid filtering processing result according to the loudspeaker sound source frequency domain signal.

3. The method of claim 1, wherein obtaining the wind noise recognition result of the earphone based on the interrelationship between the inverse feedback filtering processing result and the inverse hybrid filtering processing result comprises:

calculating a ratio of energy of the inverse hybrid filtering processing result to energy of the inverse feedback filtering processing result;

if the ratio is greater than a first preset threshold value, determining the wind noise recognition result of the earphone as absence of the wind noise; and if the ratio is less than a second preset threshold value, determining the wind noise recognition result of the earphone as presence of the wind noise, wherein the first preset threshold value is greater than the second preset threshold value.

4. The method of claim 3, wherein a frequency band with an apparent effect of the feedforward noise cancellation is selected for energy calculation and comparison in the calculating step.

5. The method of claim 1, wherein the feedback microphone frequency domain signal is directly determined as the inverse feedback filtering processing result when only the feedforward noise cancellation is enabled.

6. The method of claim 1, further comprising:

after the wind noise recognition result of the earphone is obtained, suppressing the wind noise in one or more manners of: reducing a gain of the feedforward microphone, turning off the feedforward microphone, or performing attenuation on a low-frequency signal of the feedforward microphone signal collected by the feedforward microphone.

7. An apparatus for recognizing wind noise of an earphone, the earphone comprising a feedforward microphone located outside an ear and a feedback microphone located inside the ear, wherein the apparatus comprises:

a processor; and a memory configured to store instructions executable by the processor, wherein the processor is configured to:

acquire a feedforward microphone signal collected by the feedforward microphone and a feedback microphone signal collected by the feedback microphone;

perform Fourier transform on the feedforward microphone signal and the feedback microphone signal to obtain a feedforward microphone frequency domain signal and a feedback microphone frequency domain signal;

perform inverse feedback filtering processing on feedback microphone frequency domain signal to obtain an Inverse feedback filtering processing result;

perform inverse feedforward filtering processing on the feedforward microphone frequency domain signal and the inverse feedback filtering processing result to obtain an inverse hybrid filtering processing result; and obtain a wind noise recognition result of the earphone based on an interrelationship between the inverse feedback filtering processing result and the inverse hybrid filtering processing result, wherein the inverse feedback filtering processing is implemented through the following formula:

$$FB_{invfb} = FBmic \times (1 - H_{fb} \times G),$$

wherein $FB_{invfb}$ is the inverse feedback filtering processing result, FBmic is the feedback microphone frequency domain signal, $H_{fb}$ is a frequency response of a feedback filter used when feedback noise cancellation of the earphone is enabled at a current time, and G is a transfer function from a loudspeaker inside the earphone to the feedback microphone; and the inverse feedback filtering processing is implemented by the following formula:

$$FB_{inv} = FB_{invfb} - FFmic \times H_{ff} \times G,$$

wherein $FB_{inv}$ is the inverse hybrid filtering processing result, FFmic is the feedforward microphone frequency domain signal, $H_{ff}$ is a frequency response of a feedback filter used when feedforward noise cancellation of the earphone is enabled at the current time, and G is the transfer function from the loudspeaker inside the earphone to the feedback microphone.

8. The apparatus of claim 7, wherein the processor is further configured to: after the inverse feedback filtering processing result and the inverse hybrid filtering processing result are obtained, acquire a loudspeaker sound source frequency domain signal played by a loudspeaker inside the earphone; and perform acoustic echo cancellation processing on the inverse feedback filtering processing result and the inverse hybrid filtering processing result according to the loudspeaker sound source frequency domain signal.

9. The apparatus of claim 7, wherein in order to obtain the wind noise recognition result of the earphone based on the interrelationship between the inverse feedback filtering processing result and the inverse hybrid filtering processing result, the processor is configured to:

calculate a ratio of the energy of inverse hybrid filtering processing result to energy of the inverse feedback filtering processing result;

if the ratio is greater than a first preset threshold value, determine the wind noise recognition result of the earphone as absence of the wind noise; and if the ratio is less than a second preset threshold value, determine the wind noise recognition result of the earphone as presence of the wind noise, wherein the first preset threshold value is greater than the second preset threshold value.

10. The apparatus of claim 9, wherein the processor is configured to select a frequency band with an apparent effect of the feedforward noise cancellation for energy calculation and comparison, when the ratio of the energy of the inverse hybrid filtering processing result to the energy of the inverse feedback filtering processing result is calculated.

11. The apparatus of claim 7, wherein the feedback microphone frequency domain signal is directly determined as the inverse feedback filtering processing result when only the feedforward noise cancellation is enabled.

12. The apparatus of claim 7, wherein the processor is further configured to:

after the wind noise recognition result of the earphone is obtained, suppress the wind noise in one or more manners of: reducing a gain of the feedforward microphone, turning off the feedforward microphone, or performing attenuation on a low-frequency signal of the feedforward microphone signal collected by the feedforward microphone.

13. An earphone, comprising: a feedforward microphone located outside an ear, a feedback microphone located inside the ear, a loudspeaker, a processor, and a memory that stores computer executable instructions, wherein the executable instructions, when executed by the processor, cause the processor to implement following steps of:

acquiring a feedforward microphone signal collected by the feedforward microphone and a feedback microphone signal collected by the feedback microphone;

performing Fourier transform on the feedforward microphone signal and the feedback microphone signal to obtain a feedforward microphone frequency domain signal and a feedback microphone frequency domain signal;

performing inverse feedback filtering processing on the feedback microphone frequency domain signal to obtain an inverse feedback filtering processing result;

performing inverse feedforward filtering processing on the feedforward microphone frequency domain signal and the inverse feedback filtering processing result to obtain an inverse hybrid filtering processing result; and obtaining a wind noise recognition result of the earphone based on an interrelationship between the inverse feedback filtering processing result and the inverse hybrid filtering processing result, wherein the inverse feedback filtering processing is implemented through the following formula:

$$FB_{invfb} = FBmic \times (1 - H_{fb} \times G),$$

wherein $FB_{invfb}$ is the inverse feedback filtering processing result, FBmic is the feedback microphone frequency domain signal, $H_{fb}$ is a frequency response of a feedback filter used when feedback noise cancellation of the earphone is enabled at a current time, and G is a transfer function from a loudspeaker inside the earphone to the feedback microphone; and the inverse feedback filtering processing is implemented by the following formula:

$$FB_{inv} = FB_{invfb} - FFmic \times H_{ff} \times G,$$

wherein $FB_{inv}$ is the inverse hybrid filtering processing result, FFmic is the feedforward microphone frequency domain signal, $H_{ff}$ is a frequency response of a feedback filter used when feedforward noise cancellation of the earphone is enabled at the current time, and G is the transfer function from the loudspeaker inside the earphone to the feedback microphone.

14. The earphone of claim 13, wherein the executable instructions, when executed by the processor, implement further steps of: after the inverse feedback filtering processing result and the inverse hybrid filtering processing result are obtained, acquiring a loudspeaker sound source frequency domain signal played by a loudspeaker inside the earphone; and performing acoustic echo cancellation processing on the inverse feedback filtering processing result and the inverse hybrid filtering processing result according to the loudspeaker sound source frequency domain signal.

15. The earphone of claim 13, wherein obtaining the wind noise recognition result of the earphone based on the interrelationship between the inverse feedback filtering processing result and the inverse hybrid filtering processing result comprises:

calculating a ratio of energy of the inverse hybrid filtering processing result to energy of the inverse feedback filtering processing result;

if the ratio is greater than a first preset threshold value, determining the wind noise recognition result of the earphone as absence of the wind noise; and if the ratio is less than a second preset threshold value, determining the wind noise recognition result of the earphone as presence of the wind noise, wherein the first preset threshold value is greater than the second preset threshold value.

16. The earphone of claim 15, wherein a frequency band with an apparent effect of the feedforward noise cancellation is selected for energy calculation and comparison in the calculating step.

17. The earphone of claim 13, wherein the feedback microphone frequency domain signal is directly determined as the inverse feedback filtering processing result when only the feedforward noise cancellation is enabled.

18. The earphone of claim 13, wherein the executable instructions, when executed by the processor, implement further steps of:

after the wind noise recognition result of the earphone is obtained, suppressing the wind noise in one or more manners of: reducing a gain of the feedforward microphone, turning off the feedforward microphone, or performing attenuation on a low-frequency signal of the feedforward microphone signal collected by the feedforward microphone.

* * * * *